US008607753B2

(12) United States Patent
Krause et al.

(10) Patent No.: US 8,607,753 B2
(45) Date of Patent: Dec. 17, 2013

(54) SWITCHABLE FINGER LEVER

(75) Inventors: Joachim Krause, Obermichelbach (DE); Stefan Gemein, Furth (DE); Ronny Gunnel, Puschendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 72 days.

(21) Appl. No.: 13/307,339

(22) Filed: Nov. 30, 2011

(65) Prior Publication Data

US 2012/0174886 A1 Jul. 12, 2012

(30) Foreign Application Priority Data

Jan. 12, 2011 (DE) ..... 10 2011 002 566

(51) Int. Cl.
*F01L 1/18* (2006.01)

(52) U.S. Cl.
USPC ..... 123/90.44

(58) Field of Classification Search
USPC ..... 123/90.16, 90.39, 90.44, 90.27
See application file for complete search history.

(56) References Cited

U.S. PATENT DOCUMENTS

| | | | | |
|---|---|---|---|---|
| 5,706,770 | A * | 1/1998 | Schmidt et al. | 123/90.39 |
| 6,532,920 | B1 * | 3/2003 | Sweetnam et al. | 123/90.16 |
| 6,708,660 | B2 * | 3/2004 | Seitz | 123/90.44 |
| 7,909,007 | B2 * | 3/2011 | Manther et al. | 123/90.16 |
| 7,921,821 | B2 * | 4/2011 | Rorig et al. | 123/90.44 |
| 7,926,455 | B2 * | 4/2011 | Manther et al. | 123/90.16 |
| 8,215,275 | B2 * | 7/2012 | Church | 123/90.39 |
| 8,251,032 | B2 * | 8/2012 | Manther | 123/90.39 |
| 8,393,308 | B2 * | 3/2013 | Kang et al. | 123/90.16 |
| 2007/0006837 | A1 * | 1/2007 | Seitz et al. | 123/90.39 |
| 2009/0031975 | A1 * | 2/2009 | Rorig | 123/90.39 |

FOREIGN PATENT DOCUMENTS

DE 102006046574 4/2008

OTHER PUBLICATIONS

Machine translation of DE 10 2006 046 574 A1 obtained from espacenet.com (see attached).*

* cited by examiner

*Primary Examiner* — Thomas Denion
*Assistant Examiner* — Ngoc T Nguyen
(74) *Attorney, Agent, or Firm* — Volpe and Koenig, P.C.

(57) ABSTRACT

A switchable finger lever for a valve drive of an internal combustion engine having an interior lever encompassed by arms of an exterior lever, with a joint axle extending through the levers so they are relatively pivotal. A stub projects from the axle at each exterior side, with the respective stub being encompassed by a coil section of a pivot pin spring, having one leg acting upon the exterior lever and another leg acting upon the interior lever to pre-load the levers relative to each other, with the coil section encompassing a bush encasing an exterior casing of the stub. The bush encompasses the stub with a clearance fit and, for fixation of the axle, an annular groove with a safety ring is located inside the bush bore, and engages a radially inwardly located groove in the exterior casing of the stub allowing the axle to be disassembled without destruction.

5 Claims, 2 Drawing Sheets

SWITCHABLE FINGER LEVER

CROSS-REFERENCE TO RELATED APPLICATIONS

This application claims the benefit of German Patent Application No. 102011002566.9, filed Jan. 12, 2011, which is incorporated herein by reference as if fully set forth.

FIELD OF THE INVENTION

The invention relates to a switchable finger lever of a valve drive of an internal combustion engine with an interior lever, enclosed by arms of an exterior lever, with one of the levers comprising at its surface a running surface for at least one large cam and the levers can be optionally connected to each other via coupling means as well as extend in a pivotally movable fashion in reference to each other via bores on a common axle, which axle projects at least at one exterior side of the exterior lever with a stub, with the respective stub being encased by a coil section of the pivot pin spring, with one leg projecting from an end of the coil section to the exterior lever and another leg projecting from another end of the coil section to the interior lever in the direction of rotation such that the levers are stressed in reference to each other, with the coil section encompassing a bush with its bore encompassing an outer casing of the stub.

A generic finger lever is shown in FIG. 3 of DE 10 2006 046 574 A 1. It is discernible that the bush encompassed by the coil section of the pivot pin spring engages the stub of the axle with a clear radial play. In the decoupled operation, i.e. when the interior lever in reference to the exterior lever is rotated against the force of the pivot pin spring an undesired canting of the bush can develop. This is caused due to, depending on design, the winding located respectively axial farthest inwardly or outwardly is rotated to the greatest extent and thus impacts the bush more strongly than the windings following inwardly. This canting leads to an undesired contact of the edges on the stub, leading to wear and tear, and in the worst case scenario to a separating/excursion of the axle.

Furthermore, embodiments are known in which the above-mentioned axle is caulked, riveted, or welded to its surrounding construction. Such connections cannot be disassembled without destruction, for example during the initial assembly.

SUMMARY

Thus, the invention is based on the objective of providing a finger lever of the above-mentioned type, in which its axle can be held by simple measures in a non-canting and wear-free fashion as well as easily assembled and disassembled.

This objective is attained according to the invention in that the bush encompasses the stub of the axle with a clearance fit, with an annular groove with a safety ring being applied inside the bore of the bush for the purpose of fixing the axle, which sectionally engages a radially interior opposite annular groove in the exterior casing of the stub such that the axle can be disassembled without destruction.

Due to this simple snap ring-groove connection the disadvantages mentioned at the outset are removed. The bush cannot cant any more during the lost-motion operation and carries with its bore over a considerably greater length. Thus, the axle no longer travels out of its position.

Simultaneously it is stated that the above-mentioned connection can be produced cost-effectively and that any assembly/disassembly of the axle is designed in a manner as simple as possible by easily passing it through the bore of the bush with a pre-assembled safety ring.

If the stub, as suggested in a further development of the invention, is provided with a conical transfer part starting at its exterior face, which may be called a slip bevel, the above-mentioned assemble is additionally facilitated.

Although the scope of the invention relates to at least one coil section at only one projecting stub of the axle, it is preferred to allow two stubs to project, with a coil section of each pivot pin spring or a joint pivot pin spring being located on them.

Due to the bush, suggested by the more precise definition of the invention, being in a mirror-symmetrical position in reference to the lateral central plane (central annular groove) its alignment during installation is omitted. Alternatively to the above-mentioned design, the bush may also be provided at both facial sides with an adjacent annular groove.

A good axial guide for the bush is given when, which is the objective of another embodiment of the invention, said bush extends axially inwardly directly adjacent to the respective exterior face of the exterior lever.

BRIEF DESCRIPTION OF THE DRAWINGS

The invention is explained in greater detail using the drawings.

Shown are.

DETAILED DESCRIPTION OF THE PREFERRED EMBODIMENTS

Figure 1:
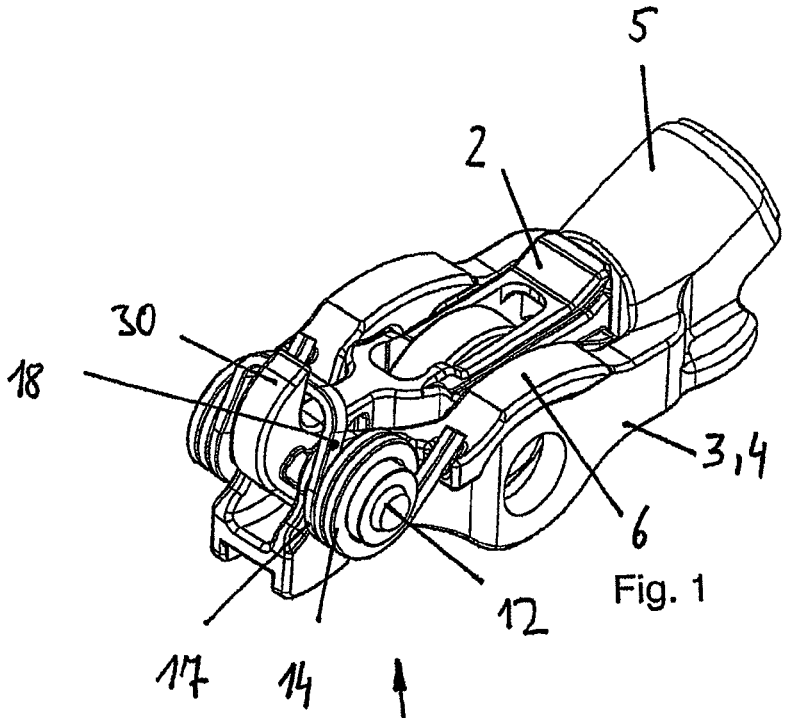
FIG. 1 is a perspective overall view of the finger lever.

A switchable finger lever 1 of a valve drive of an internal combustion engine is shown. It comprises a longitudinal interior lever 2 with a cam following roller 29. The interior lever 2 is encompassed by arms 3 of an exterior lever 4. The top sides 5 of the arms 3 of the exterior lever 4 are shown as running surfaces 6, embodied as glide surfaces, for cams.

Here, the finger lever 1, mounted for example at the side of the exhaust valve, may be used for an internal exhaust return into a quality-controlled internal combustion engine, such that via the approach of an off-set cam with low elevation on the cam following roller 29 of the interior lever 2, residual gas is suctioned back into the combustion chamber in the suction phase. Also, a valve lift activation or shut-off is possible and provided. Here, for example a large cam would contact the cam guide surface 29 and small cams would counter on the running surfaces 6 of the exterior lever 4.

The levers 2, 4 can optionally be connected to each other via longitudinally displaceable coupling means 7, not shown in greater detail.

The levers 2, 4 are located via bores 8, 9 on a common axle 10, pivotal in reference to each other. The axle projects at the exterior sides 11 of the exterior lever 4 with one stub 12 each. Each stub 12 is encompassed by a coil section 13 of a pivot pin spring 14. A leg 16 projecting downwards from an exterior end 15 of the coil section acts upon the exterior lever 4 and another leg 18 projecting from an interior end 17 of the coil section 13 upwards acts upon a cam-like extension 30 of the interior lever 2 in the rotary direction such that the levers 2, 4 are pre-loaded in reference to each other.

Each coil section 13 encompasses a bush 21, encompassing an exterior casing 19 of the stub 12 with its bore 20. The respective bush 21 encompasses the stub 12 with a clearance fit such that no radial space is given. In order to fix the axle 10 inside the bore 20 of the bush 21, an annular groove 22 is provided with a safety ring 23. The safety ring 23 sectionally engages an annular groove 24, located opposite radially inwardly, in the exterior casing 19 of the stub 12. The axle 10 can therefore also be disassembled without destruction, particularly because during the assembly no material deformation or the like must be carried out, as is the case in caulking.

Figure 4:
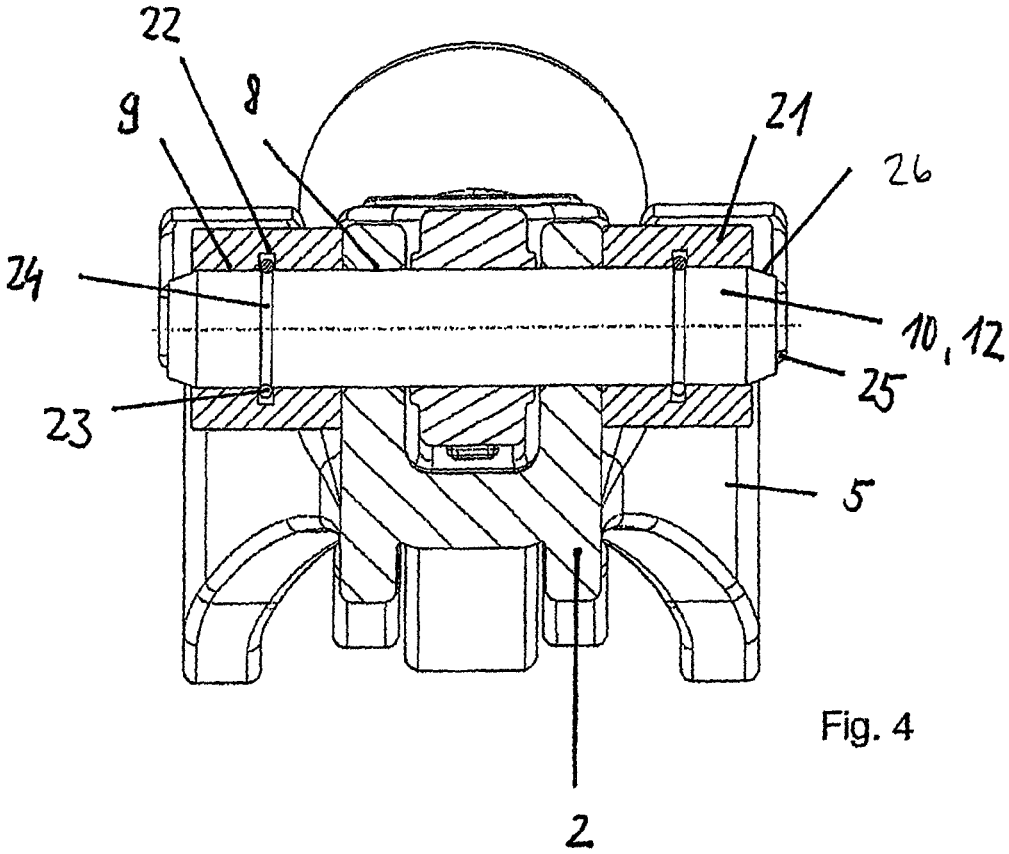
FIG. 4 is a cross-sectional view through the finger lever in the area of the axle shown enlarged.

As best discernible from FIG. 4 each stub 12 has a conical transfer section 26 from its exterior face 25 to its exterior casing 19. This may also be called a "slip bevel", by which a lateral assembly of the axle 10 is facilitated by insertion into the bores 9, 8 of the bushes 21 and the interior lever 2.

Figure 2:
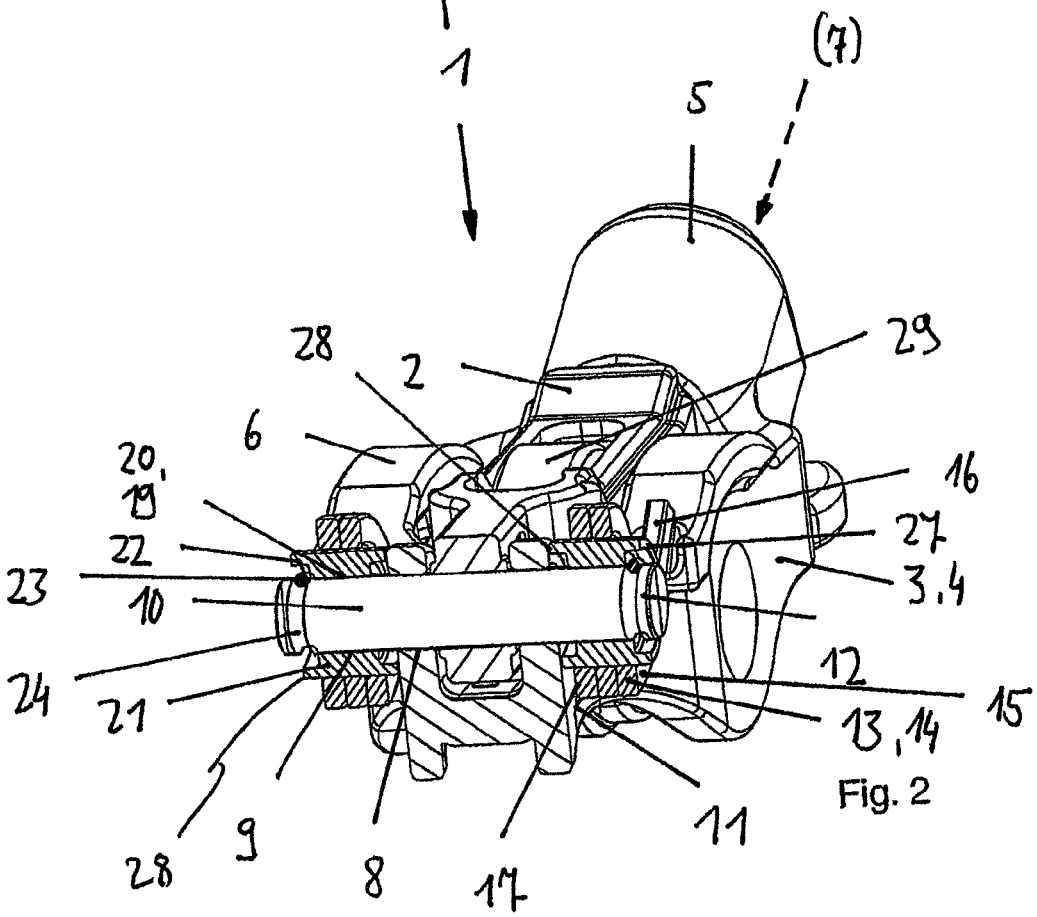
FIG. 2 is a view of the finger lever from the side of the end of the valve, with a laterally cross-sectioned axial section as well as bushes with annular grooves respectively located at the outside.

It is discernible from FIG. 2 that each bush 21 comprises an annular groove at both sides adjacent to its faces 27, 28, with the axially outside located annular groove representing the annular groove 22 with the safety ring 23. The bushes 21 are additionally mirror-symmetrical in reference to their lateral central plane so that no aligned assembly is required.

Figure 3:
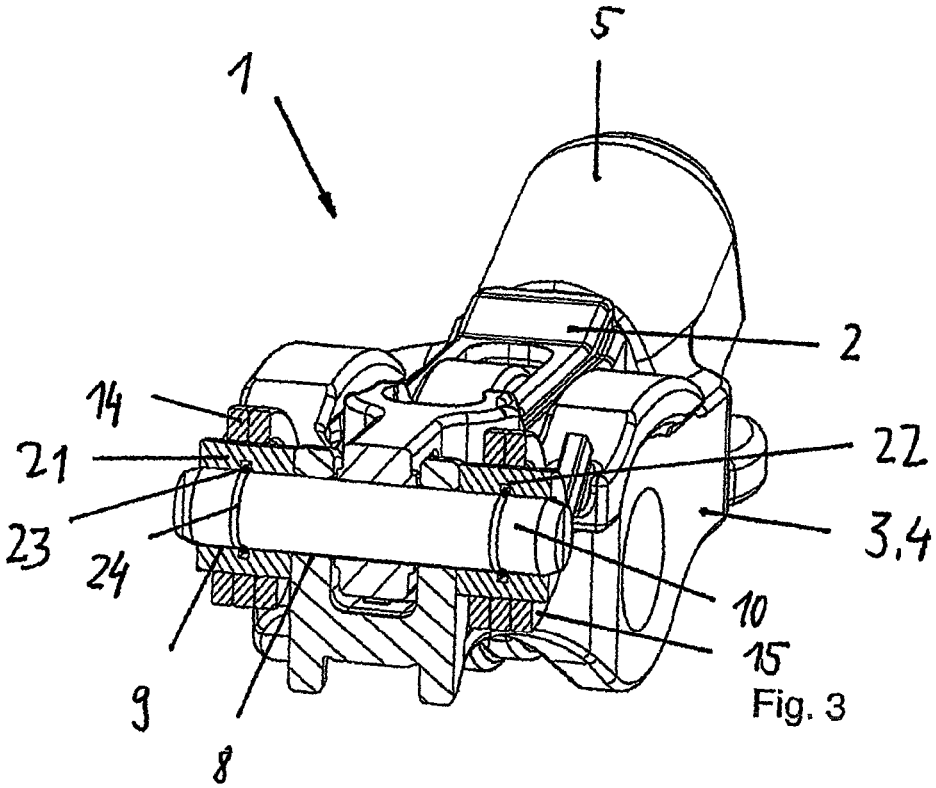
FIG. 3 is a view of the finger lever as mentioned above, however with bushes with a respective central annular groove.

FIG. 3 discloses an annular groove 22 with a safety ring 23, centrally located in the bore 20 of the respective bush 21. The bush 21 is also mirror-symmetrical in reference to its lateral central plane.

Additionally it is discernible in FIGS. 2-4 that the respective bush 21 with its interior face 27 approaches the exterior lever 4 at the respective exterior side 11 as well as extends with its exterior face 28 axially outwardly to the conical transfer section 26, so that a good support picture develops.

LIST OF REFERENCE NUMBERS

1) Finger lever
2) Interior lever
3) Arm
4) Exterior lever
5) Top side
6) Running surface
7) Coupling means
8) Bore
9) Bore
10) Axle
11) Exterior side
12) Stub
13) Coil section
14) Pivot pin spring
15) End
16) Leg
17) End
18) Leg
19) Exterior casing
20) Bore
21) Bush
22) Annular groove
23) Safety ring
24) Annular groove
25) Exterior face
26) Transition part
27) Face
28) Face
29) Cam stop roll
30) Extension

The invention claimed is:

1. A switchable finger lever for a valve drive of an internal combustion engine, comprising an interior lever, enclosed by the arms of an exterior lever, with one of the levers comprising at a top side a running surface for at least one large cam and with the levers being connected optionally via a coupling as well as being connected via a common axle extending through bores in the levers so that they are pivotal in reference to each other, the axle projects at least at one exterior side of the exterior lever with a stub, with the stub being encompassed by a coil section of a pivot pin spring, with a first leg projecting from an end of the coil section acting upon the exterior lever and a second leg projecting from another end of the coil section acting on the interior lever in a direction of rotation such that the levers are pre-loaded in reference to each other, with the coil section encompassing a bush located on an exterior casing of the stub, the bush includes a bore and encompasses the stub with a clearance fit, and for fixing the axle in position, an annular groove is located inside the bore of the bush adjacent to at least one exterior face of the bush, and a safety ring is located in the annular groove and in a radially inward, opposite annular groove in the exterior casing of the stub such that the axle can be disassembled without destruction.

2. The finger lever according to claim 1, wherein the stub is provided with a conical transfer section that extends from an exterior face thereof to the exterior casing thereof.

3. The finger lever according to claim 1, wherein the bush comprises an annular groove at both of the exterior faces, with one of the annular grooves forming the annular groove with the safety ring, so that the bush is mirror symmetrical in reference to a lateral central plane.

4. The finger lever according to claim 1, wherein the axle projects at both of the exterior sides of the exterior lever with a respective one of the stubs.

5. The finger lever according to claim 2, wherein the bush moves with an interior face thereof at the respective exterior side of the exterior lever as well as extends with an exterior face thereof at least to the conical transfer section.

* * * * *